US010287088B2

(12) United States Patent
Davideit et al.

(10) Patent No.: US 10,287,088 B2
(45) Date of Patent: May 14, 2019

(54) MOUNTING CUP AND VALVE ASSEMBLY COMBINATION WITH COMPRESSIBLE MEMBER

(71) Applicant: SUMMIT PACKAGING SYSTEMS, INC, Manchester, NH (US)

(72) Inventors: Daniel E. Davideit, Manchester, NH (US); Elizabeth A. Green, Kingston, NH (US)

(73) Assignee: Summit Packaging Systems, Inc., Manchester, NH (US)

( * ) Notice: Subject to any disclaimer, the term of this patent is extended or adjusted under 35 U.S.C. 154(b) by 27 days.

(21) Appl. No.: 15/377,295

(22) Filed: Dec. 13, 2016

(65) Prior Publication Data

US 2018/0162629 A1 Jun. 14, 2018

(51) Int. Cl.
*B65D 83/20* (2006.01)
*B65D 83/32* (2006.01)
*B65D 83/48* (2006.01)

(52) U.S. Cl.
CPC ..... *B65D 83/48* (2013.01); *B65D 83/20* (2013.01); *B65D 83/32* (2013.01)

(58) Field of Classification Search
CPC ..... B65D 83/48; B65D 83/44; B65D 83/20; B65D 83/32
See application file for complete search history.

(56) References Cited

U.S. PATENT DOCUMENTS 3,282,474 A * 11/1966 Gorman ..... B65D 83/64 222/136
3,348,742 A * 10/1967 Assalit ..... B65D 39/00 222/394

(Continued)

FOREIGN PATENT DOCUMENTS

DE 3041198 A1 * 5/1982 ..... B65D 83/48
DE 19710541 A1 * 9/1998 ..... B65D 83/48

(Continued)

OTHER PUBLICATIONS

International Search Report Corresponding to PCT/US2017/060326 dated Feb. 26, 2018.

(Continued)

*Primary Examiner* — Nicholas J. Weiss
(74) *Attorney, Agent, or Firm* — Davis & Bujold, PLLC; Michael J. Bujold

(57) ABSTRACT

An improved mounting cup and valve assembly combination for an aerosol container. The combination comprises a mounting cup which has a pedestal portion and a perimeter curl, a valve stem which has a product outlet and at least one radial orifice formed therein which communicates with the product outlet, an open ended valve body defining an interior chamber, the valve body has a dip tube coupling adjacent a partially closed base thereof, and the dip tube coupling facilitates conveying product to be dispensed into the interior chamber of the valve body, and a gasket is sandwiched between the mounting cup and the valve body. The base of the valve body forms a first seat while a surface of the valve stem, facing toward the dip tube coupling, forms a second seat. A rubber compressible member is captively retained between the first and the second seats.

20 Claims, 13 Drawing Sheets

(56) References Cited

U.S. PATENT DOCUMENTS

| | | | | |
|---|---|---|---|---|
| 3,586,068 | A * | 6/1971 | Nicholson | B65D 83/48 141/20 |
| 4,135,648 | A | 1/1979 | White | |
| 4,754,897 | A * | 7/1988 | Brace | B65D 83/44 138/45 |
| 6,296,155 | B1 | 10/2001 | Smith | |
| 6,832,704 | B2 | 12/2004 | Smith | |

FOREIGN PATENT DOCUMENTS

| | | | | |
|---|---|---|---|---|
| FR | 2684969 | A1 * | 6/1993 | B65D 83/48 |
| JP | 10068649 | A * | 3/1998 | B65D 83/48 |

OTHER PUBLICATIONS

Written Opinion Corresponding to PCT/US2017/060326 dated Feb. 26, 2018.

* cited by examiner

CROSS-SECTION OF
BALL RESTING ON BODY

FEMALE VALVE - CLOSED

FEMALE VALVE - OPEN

MOUNTING CUP AND VALVE ASSEMBLY COMBINATION WITH COMPRESSIBLE MEMBER

FIELD OF THE INVENTION

This invention relates to pressurized spray containers or canisters in general and, more particularly, to a valve assembly arrangement, supported by a mounting cup, for use with such pressurized spray canisters with dispensing product without having any internal metal spring, or other metallic component(s), located along the flow path of the product through the valve assembly arrangement.

BACKGROUND OF THE INVENTION

Pressurized spray canisters have long been utilized as economical, convenient, and portable storage and dispensing devices, accommodating products as diverse as paint, insecticide, whipped cream, materials which are corrosive and react with metals, etc. Because of the pressurized spray canister's wide spread popularity and applicability, millions and millions of units are manufactured and sold each year throughout the world. Improvements in the design and manufacturing processes are constantly sought after by the spray canister industry, since even a very minor cost reduction per unit can quickly accumulate into large scale production savings. Moreover, depending upon the particular product to be dispensed, certain design modifications must be incorporated into the valve assembly arrangement in order to facilitate proper and consistent dispensing of the product to be dispensed.

Pressurized spray canisters typically have a cylindrical metal container or canister with an access opening which is sealed by a mounting cup and valve assembly combination. Alternatively, a metal pressure dome may seal a wider open end of the canister, with the mounting cup and valve assembly, in turn, sealingly engaging with a central opening of the pressure dome. This causes a valve stem and spray button portion of the valve assembly to be disposed a greater distance away from a top surface of the canister, which facilitates more accurate and easier product dispensing.

Two types of valve assemblies are typically provided with pressurized spray canisters. One is a vertical depression-valve assembly, where product is dispensed when the valve stem is sufficiently depressed substantially vertically along the vertical axis of the valve. The other is a tilt-valve assembly, where product is dispensed when the valve stem is sufficiently tilted relative to the vertical axis of the valve. The former is most often used in conjunction with right-angle spray buttons and actuators for spraying product radially with respect to the canister, while the later is most often used with spray-through spray buttons and actuators for providing off-axis dispensing.

In addition, it is to be appreciate that both "male" valve and "female" valves are utilized. As is well known, male valves typically include a valve stem which projects from the valve assembly out through the central aperture of the mounting cup while female valves typically do not include any valve stem which projects from the central aperture of the mounting cup. The valve stem is typically manufactured as part of the actuator and extends through the central aperture of the mounting cup to facilitate actuation of the valve assembly.

During use, once the valve stem is sufficiently depressed, e.g., either vertically or tilted (causing one side portion of the valve stem base to "bite into the gasket" while the opposite side portion of the valve stem base to be sufficiently lifted or spaced away from the gasket), the product to be dispensed from the canister is allowed to flow past this internal seal. The product to be dispensed then communicates with the one or more radial orifices, formed in the valve stem, and flows radially inwardly and vertically upward, along the passageway in the valve stem, and eventually out through a discharge outlet of a spray button or actuator, in a conventional fashion.

While the above mentioned valves have worked satisfactorily for many applications, it is noted that some of the internal components, such as springs, may react with or alter or modify one or more physical characteristics, properties and/or attributes of the product to be dispensed as such product flows through the valve assembly.

SUMMARY OF THE INVENTION

Wherefore, it is an object of the present invention to provide a mounting cup and valve assembly combination which does not alter or modify any physical characteristic, property and/or attribute of the product to be dispensed as the product flows through the valve assembly.

Another object of the invention is to provide a valve assembly which does not have any internal metal spring, or other metallic component(s), which is located along the flow path of the product to be dispensed, so that such metallic spring or other metallic component does not alter or modify one or more physical characteristics, properties and/or attributes of the product to be dispensed resulting from contact with such internal metal spring or other metallic component(s).

Still another object of the present invention is to provide a compressible member, which is located between a base of the valve stem and a base of the valve body, that is compressible, when the valve stem is depressed by an operator, so as to permit the valve stem to be move axially toward the valve body and permit the flow of the product to be dispensed past the seal and through the valve assembly, and, when the valve stem is no longer depressed by an operator, the compressible member automatically biases the valve stem back into its normally closed and sealed position, against the gasket, to prevent further dispensing of the product to be dispensed through the valve assembly.

Yet another object of the present invention is to utilize an internal compressible member which is normally resistant to oil, fuel and/or other chemicals and is generally manufactured from rubber, such as nitrile rubber (also known as Buna-N Perbunan or NBR), which is a synthetic rubber copolymer of acrylonitrile (ACN) and butadiene, so as to minimize the possibility of the compressible member reacting, modifying or otherwise altering the one or more physical characteristics, properties and/or attributes of the product to be dispensed.

A further object of the present invention is to provide a non-metallic compressible member which is manufactured from a material which is generally unreactive and/or inert to the particular product to be dispensed and thus avoids, when communicating and/or contacting the product to be dispensed, reacting, altering and/or modifying any physical characteristic, property and/or attribute of the product to be dispensed as such product flows through the valve assembly.

The present invention relates to an improved mounting cup and valve assembly combination for an aerosol container, the combination comprising: a mounting cup having a pedestal portion and a perimeter curl; a valve stem having a product outlet and at least one radial orifice being formed therein and communicating with the product outlet; a valve body being opened at a first end and defining an interior chamber, the valve body having a dip tube coupling adjacent a partially closed base thereof, and the dip tube coupling facilitates conveying product to be dispensed into the interior chamber of the valve body; and a gasket being sandwiched between the valve body and the mounting cup; wherein the base of the valve body forms a first seat while a surface of the valve stem, facing toward the partially closed base, forms a second seat; and a rubber compressible member is captively retained between the first and the second seats.

The present invention also relates to an improved mounting cup and valve assembly combination for an aerosol container, the combination comprising: a mounting cup having a pedestal portion and a perimeter curl, and an aperture being formed in the pedestal portion of the mounting cup; a valve stem having a cylindrical tubular section extending from a valve stem base of the valve stem, a product outlet being formed in a free end of the cylindrical tubular section, and at least one radial orifice being formed in the cylindrical tubular section and communicating with the product outlet; a valve body being opened at a first end and defining an interior chamber, the valve body having a dip tube coupling adjacent a partially closed base thereof, and the dip tube coupling being connected to a dip tube to facilitate conveying product to be dispensed into the interior chamber via a passage outlet; the open first end of the valve body receiving the valve stem; a gasket being sandwiched between the open end of the valve body and the mounting cup with a portion of the cylindrical tubular section extending through the aperture in the mounting cup; and an actuator, with a discharge outlet, frictionally engaging with the free end of the cylindrical tubular section to facilitate dispensing of the product to be dispensed; wherein the partially closed base of the valve body forms a first seat while a surface of the valve stem, facing toward the partially closed base, forms a mating second seat; a rubber compressible member is captively retained between the first and the second seats without obstructing the passage outlet of the valve base; and the compressible member normally biases the valve stem into sealing engagement with the gasket while still being sufficiently compressible so as to permit the valve stem to be moved out of sealing engagement with the gasket and permit product flow through the valve assembly.

The additionally relates to an improved mounting cup and valve assembly combination for an aerosol container, the combination comprising: a mounting cup having a pedestal portion and a perimeter curl; a valve body being opened at a first end and defining an interior chamber, the valve body having a product outlet formed in a base thereof which facilitates conveying product to be dispensed into the interior chamber of the valve body; a valve stem being received within the interior chamber of the valve body; a gasket being sandwiched between the valve body and the mounting cup and normally preventing flow of product to be dispensed through valve assembly; wherein the base of the valve body forms a first seat while a surface of the valve stem, facing toward the partially closed base, forms a second seat; and a rubber compressible member is captively retained between the first and the second seats for biasing the valve stem into sealing engagement with the gasket to prevent the flow of the product to be dispensed through valve assembly.

The present invention finally relates to a method of forming an improved mounting cup and valve assembly combination for an aerosol container, the method comprising: forming a mounting cup with a pedestal portion and a perimeter curl; providing a valve stem with a product outlet and at least one radial orifice formed therein which communicates with the product outlet; forming a valve body so as to be opened at a first end and define an interior chamber, the valve body having a dip tube coupling located adjacent a partially closed base thereof, and the dip tube coupling facilitates conveying product to be dispensed into the interior chamber of the valve body; sandwiching a gasket between the valve body and the mounting cup; forming a first seat in the partially closed base of the valve body and forming a second seat in a surface of the valve stem facing toward the partially closed base; and captively retaining a rubber compressible member between the first and the second seats.

BRIEF DESCRIPTION OF THE DRAWINGS

The invention will now be described, by way of example, with reference to the accompanying drawings in which.

DESCRIPTION OF THE PREFERRED EMBODIMENTS

Turning now to FIGS. 1-5, a detailed description concerning the present invention will now be provided.

Figure 1:
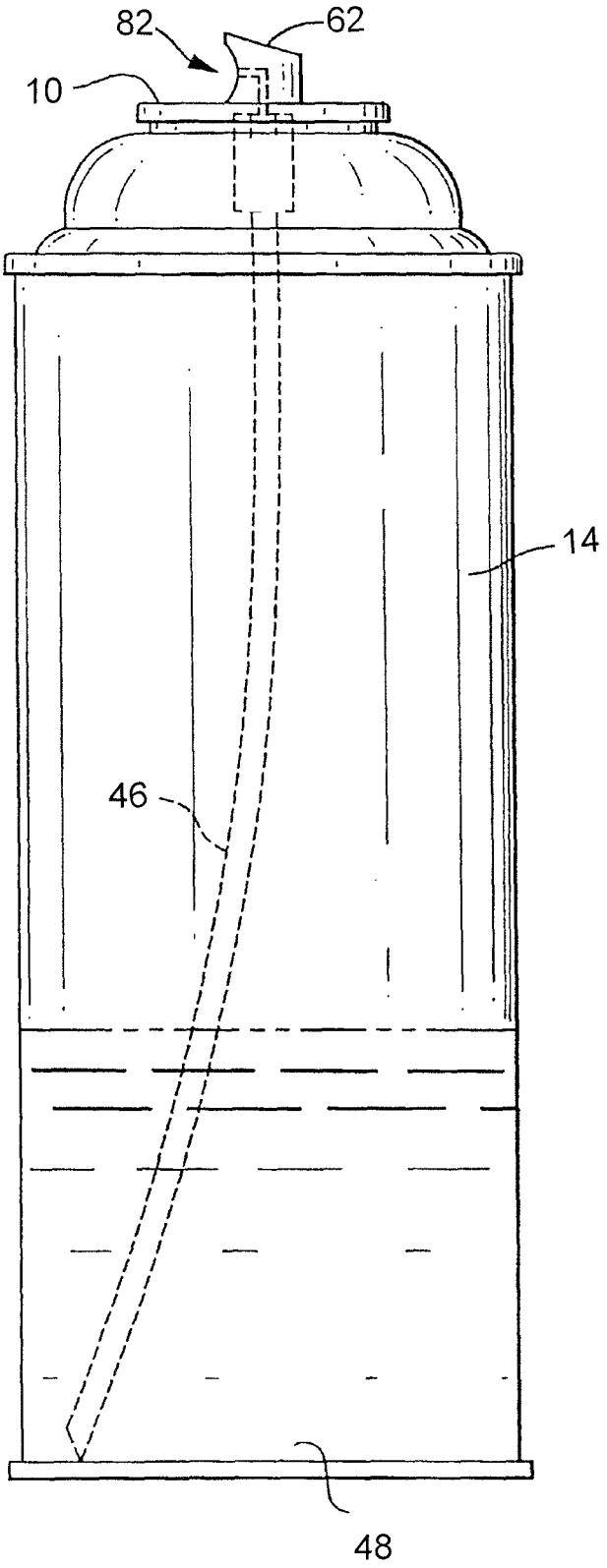
FIG. 1 is a diagrammatic view of a mounting cup and valve assembly combination with a compressible member, according to the present invention, shown attached to a spray canister.
Figure 2:
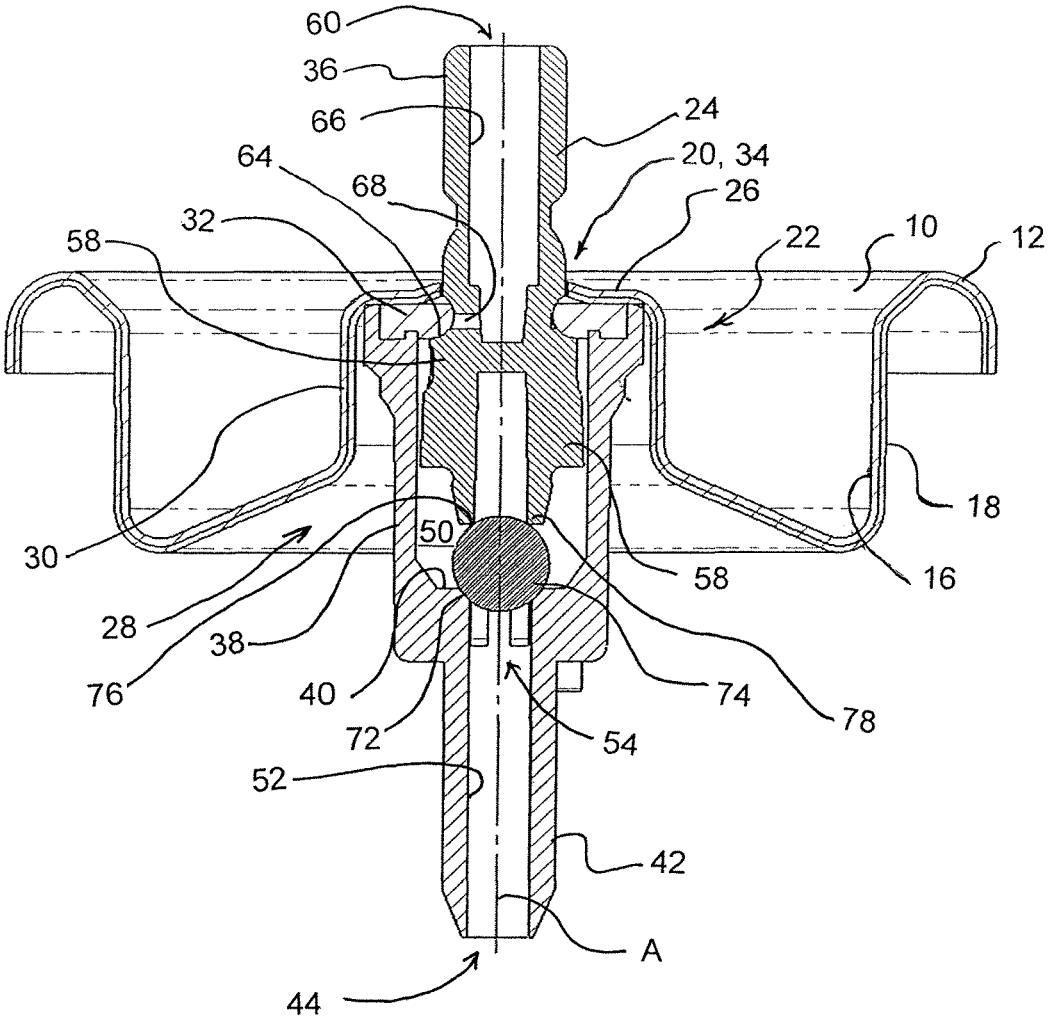
FIG. 2 is a diagrammatic cross-sectional view of the mounting cup and valve assembly combination with the compressible member, prior to crimping.

Turning first to FIGS. 1 and 2, a brief description concerning the various components of the present invention will now be briefly discussed and this will then be followed by a detailed description of the present invention. As can be seen in FIG. 2 for example, the mounting cup 10 is provided with a perimeter curl 12 for attaching the mounting cup 10 to a rim of a desired pressurizable container or canister 14 (see FIG. 1), or to a rim of a dome (not shown) which, in turn, is attached to a pressurizable container or canister 14. The mounting cup 10 has an outwardly facing surface 16 and an inwardly facing surface 18. A central aperture 20 is provided in mounting cup 10, in the region of a pedestal portion 22, for accommodating a valve stem 24 of a male valve. The pedestal portion 22 has a generally flat top wall 26, for accommodating a valve assembly 28 and a generally vertical cylindrical side wall 30, prior to crimping (see FIG. 2).

Figure 3:
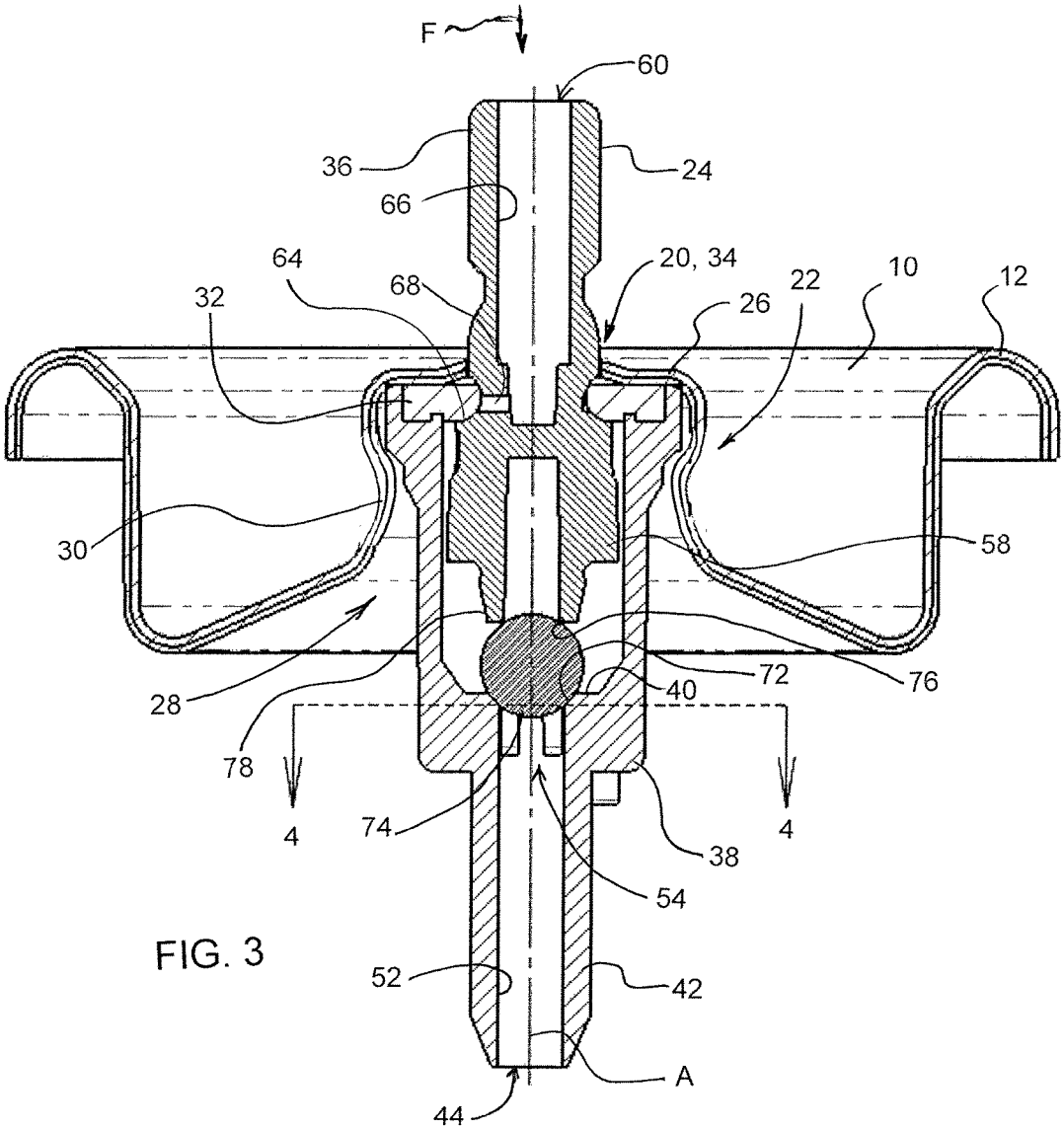
FIG. 3 is a diagrammatic cross-sectional view of the mounting cup and valve assembly combination of FIG. 2, following crimping of the mounting cup, with the valve shown in its closed unactuated position.

A generally flat gasket 32 is disposed along the inwardly facing surface 18 of the top wall 26 of the pedestal portion 22. The gasket 32 has a central aperture 34 formed therein which is typically slightly smaller in size than the aperture 20 provided in the pedestal portion 22 of the mounting cup 10, so as to provide a snug seal with respect to a cylindrical tubular section 36 of a valve stem 24. As generally shown in FIGS. 2 and 3, the aperture 34 of the gasket 32 is aligned with the aperture 20 provided in the pedestal portion 22 and the valve stem 24 passes through both the aperture 20 in the pedestal portion 22 and the aperture 34 of the gasket 32. The valve assembly 28 and the valve stem 24 together define a longitudinal axis A for the improved mounting cup and valve assembly combination. Following crimping of the mounting cup (see FIG. 3), the generally vertical cylindrical side wall 30 of the mounting cup is forced radially inward into engagement with an exterior surface of a valve body 38 in order to permanently attach the valve assembly 28 to the mounting cup 10.

The valve body 38 is generally a hollow longitudinal cylindrical member which is open at a top end thereof and partially closed adjacent a base 40 thereof. The open end of the valve body 38 receives and accommodates the valve stem 24 while the partially closed base 40 of the valve body 38 is provided with a cylindrical dip tube coupling 42 which has an inlet 44, formed in a bottom most free end of the dip tube coupling 42. As generally shown in FIG. 1, a first end of a dip tube 46 is connected, in a conventional manner, to the dip tube coupling 42 while a second remote end of the dip tube 46 is located, following installation with the canister 14, adjacent the bottom area of the pressurized canister 14 for directly communicating with the product to be dispensed 48 and facilitating conveyance of the product to be dispensed 48 from a lower portion of the pressurized canister 14 into an internal cavity 50 of the valve body 38.

The inlet 44 communicates, via a constant diameter supply passage 52, with a passage outlet 54, formed in the base 40 of the valve body 38, which facilitates discharge of the product to be dispensed 48 into the interior chamber 50 of the valve body 38. The dip tube 46, the product inlet 44, the supply passage 52, and the passage outlet 54 cooperate with one another to facilitate the flow of the product to be dispensed 48 from the pressurized canister 14 into the central interior chamber 50 of the valve body 38 for dispensing via the actuator 62, in a conventional manner.

Figure 5:
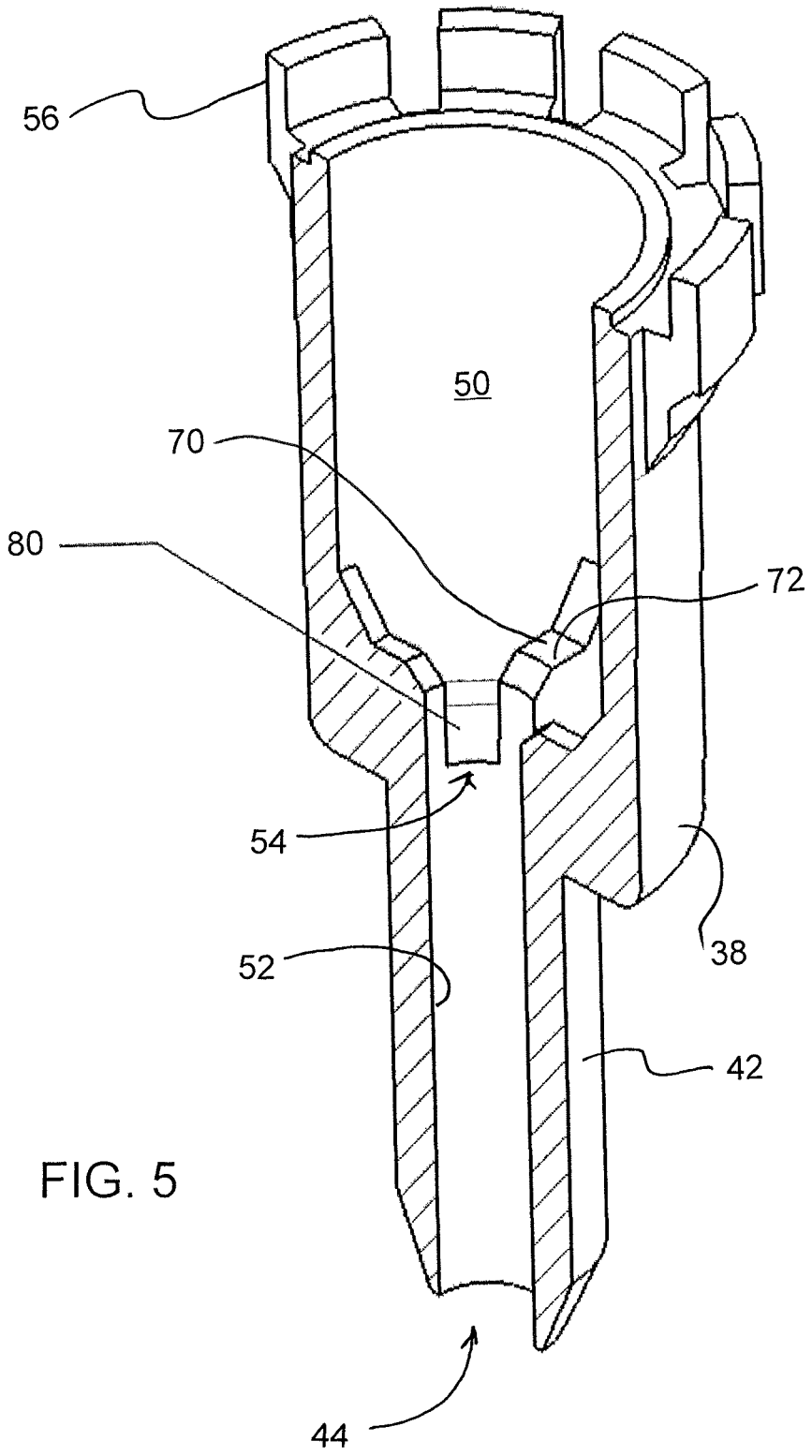
FIG. 5 is a diagrammatic perspective cross sectional view of the valve body for accommodating the compressible member.

As shown in FIG. 5, the open end of the valve body 38 includes a perimeter, circumferential rim 56 which is sized, shaped and dimensioned to engage with and form a seal with an outer perimeter region of the gasket 32, following crimping. The open end of the valve assembly 28 accommodates the valve stem 24 which includes a valve stem base 58 and the cylindrical tubular section 36 which extends from the valve stem base 58. A product outlet 60 is formed at the opposite end of the generally cylindrical tubular section 36. A longitudinal through-bore or outlet product passage 66 extends through the generally cylindrical tubular section 36 from adjacent the valve stem base 58 to the product outlet 60 of the generally cylindrical tubular section 36. The valve stem base 58 has a circumferential sealing surface 64, facing toward the gasket 32, which is radially spaced from the generally cylindrical tubular section 36.

Figure 6:
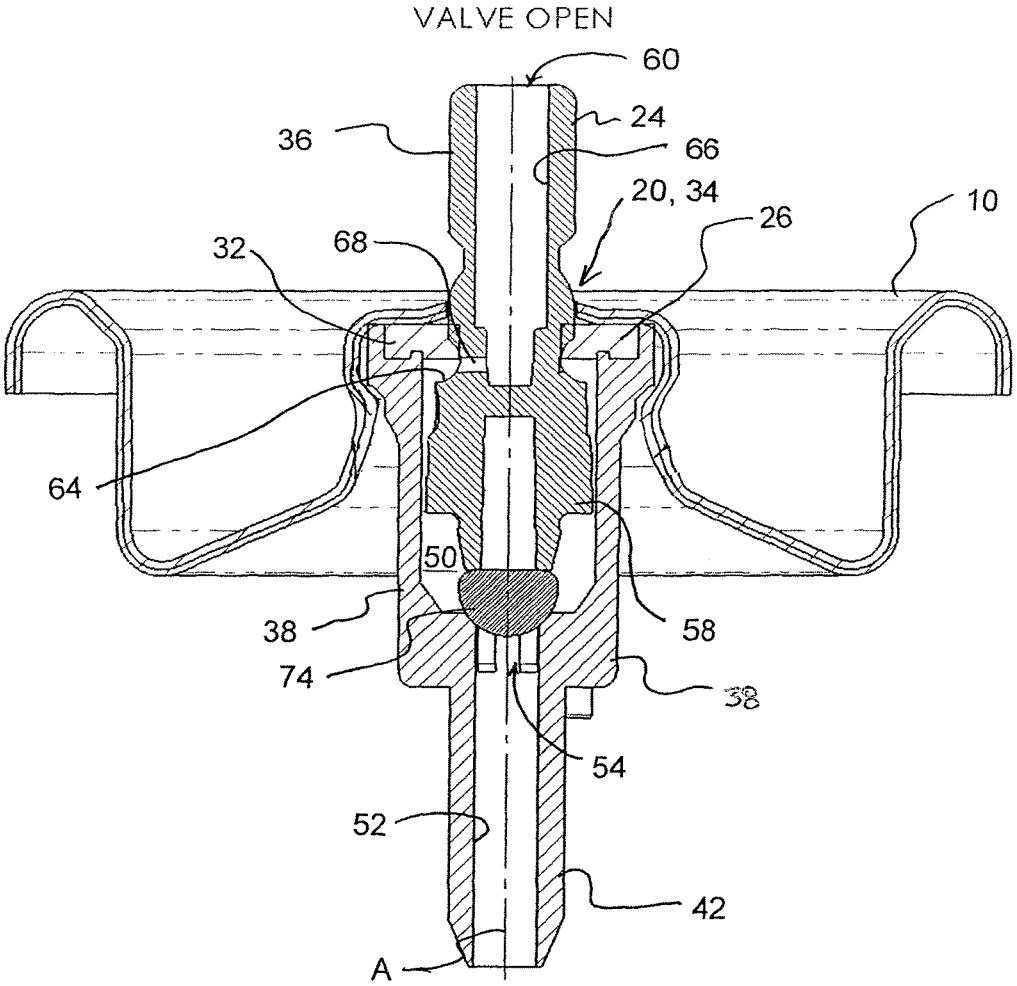
FIG. 6 is a diagrammatic cross-sectional view of the mounting cup and valve assembly combination of FIG. 3 shown in its open actuated position.

At least one and possibly a plurality of radially extending orifices 68, see FIGS. 2, 3 and 6, extends through the cylindrical tubular section 36 at a location proximate to but spaced from the valve stem base 58 so as to provide a product flow path into the longitudinal through-bore or the outlet product passage 66, when the valve stem 24 is sufficiently depressed, as shown in FIG. 6. It is to be appreciated that the shape, size and/or orientation of the radial orifices 68 can vary depending upon the particular application, without departing from the spirit and scope of the invention. A conventional actuator 62 (see FIGS. 1 and 8) typically frictionally engages with the free end of the cylindrical tubular section 36 of the valve stem 24 to facilitate dispensing of the product to be dispensed 48.

As shown in FIG. 5 for example, a plurality of spacer walls or members 70, e.g., generally between 2 and 6 product spacer members, project axially upward from the partially closed base 40 of the valve body 38 and the upper surface of each of the spacer members 70, facing toward the open end of the valve body 38, combine with one another to form an annular first seat 72 for accommodating a first portion of a compressible member 74. As shown in FIG. 3 for example, a vertically lower most base surface 78 of the valve stem base 58, facing toward the partially closed base 40 of the valve body 38, forms a mating annular second seat 76. That is, the mating annular second seat 76 is a contoured (annular in this embodiment) surface which is sized and shaped to matingly engage with an exterior surface of the compressible member 74. Following installation as discussed below, the compressible member 74 is accommodated within the interior chamber 50 of the valve body 38, between the first seat 72 and the mating second seat 76. As a result of such arrangement, following assembly, the compressible member 74 is generally captively retained within the interior chamber 50 of the valve body 38 between the first seat 72 and the mating second seat 76 (see FIGS. 2, 3 and 6, for example).

It is to be appreciated that the overall size, shape and dimensions of each of plurality of spacer walls or members 70 can vary, from application to application, without departing from the spirit and scope of the present invention. It is also to be appreciated that the overall size, shape and dimensions of each of the first seat 72 and the mating second seat 76 can vary, from application to application, without departing from the spirit and scope of the present invention.

Figure 4:
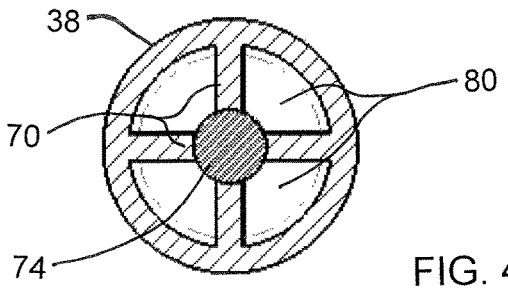
FIG. 4 is a diagrammatic cross-sectional view of the valve assembly combination and the compressible member along section line 4-4 of FIG. 3.

As best shown in FIGS. 4 and 5, the valve body 38 typically has at least one radially and axially extending product bypass slot 80, e.g., four product bypass slots are shown is these figures. Typically, a respective product bypass slot 80 is formed between each adjacent pair of the plurality of spacer members 70, e.g., generally between 2 and 6 product bypass slots or so are formed in the valve body 38. Each one of the product bypass slots 80 constantly and continuously permits the product to be dispensed 48 to flow out from the passage outlet 54 of the valve body 38, around and past the compressible member 74 and into the interior chamber 50 of the valve body 38 while the compressible member 74 remains constantly and continuously seated on the first seat 72 of the valve body 38. That is, each product bypass slot 80 forms a product bypass passageway in which the flow therethrough is not obstructed by the compressible member 74, since the compressible member 74 remains permanently and constantly seated on the first seat 72 which is located above and axially spaced from the passage outlet 54.

It is to be appreciated that the overall size, shape and dimensions of the product bypass slots 80 can vary, from application to application, without departing from the spirit and scope of the present invention. The important aspect of the spacer members 70 is that they sufficiently space the compressible member 74, away from the passage outlet 54 of the valve body 38, to define at least one product bypass slot 80 so that the product to be dispensed 48 can constantly and continuously flow into the interior chamber 50 of the valve body 38 without being obstructed by the compressible member 74.

It is to appreciated that the compressible member 74 can have a variety of different shapes and sizes depending upon the particular application at hand. As shown in FIG. 2 for example, the compressible member 74 may be a spherical rubber ball manufactured from nitrile rubber, also known as Buna-N Perbunan or NBR, which is a synthetic rubber copolymer of acrylonitrile (ACN) and butadiene. The compressible member 74 is normally resistant to oil, fuel and other chemicals so as to minimize the possibility of the compressible member 74 reacting or otherwise altering one or more physical or chemical characteristics, properties and/or attributes of the product to be dispensed 48. That is, compressible member 74 is a non-metallic compressible member which is manufactured from a material which is generally unreactive and/or inert with respect to the product to be dispensed 48. Thus, when the product to be dispensed 48 is brought into contact and/or communicates with the compressible member 74, the compressible member 74 is inert and thus does not alter or modify any physical or chemical characteristic, property and/or attribute of the product to be dispensed 48 as the product to be dispensed 48 flows through the valve assembly 28.

Figure 2A:
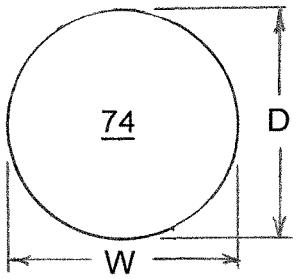
FIG. 2A is a diagrammatic view of an embodiment of the compressible member according to the present invention.

The compressible member 74 typically has a height dimension D (see FIG. 2A), e.g., measured along the vertical axis A of the valve assembly 28, of between 0.050 and 0.500 of an inch. The compressible member 74 normally biases the circumferential sealing surface 64 of the valve stem 24 axially away from the partially closed base 40 of the valve body 38 and into sealing engagement with an undersurface of the gasket 32. However, when the valve stem 24 is depressed and moved toward the partially closed base 40 of the valve body 38 by an operator, the compressible member 74 is, in turn, sufficiently compressed so that its height dimension D decreases and the circumferential sealing surface 64 of the valve stem 24 moves out of sealing engagement with the gasket 32 and thereby permits the product to be dispensed 48 to flow from of the interior chamber 50 into the radial orifice(s) 68 and the outlet product passage 66 and eventually toward the discharge orifice 82 of the actuator 62, see FIGS. 1 and 8.

During assembly of the improved mounting cup and valve assembly combination, the compressible member 74 is first received on and supported by the first seat 72 of the valve body 38. Next, the valve stem 24 is inserted into interior chamber 50 so that the compressible member 74 is located and captively retained between the first seat 72 and the mating second seat 76 supported by the valve stem base 58. Thereafter, the gasket 32 is installed on the cylindrical tubular section 36 of the valve stem 24. These assembled components of the valve assembly are then positioned within the pedestal portion 22 of the mounting cup 10 so that the gasket 32 abuts against the inwardly facing surface 18 of the top wall 26 of the pedestal portion 22 and the cylindrical tubular section 36 of the valve stem 24 extends out through the aperture 20 in the pedestal portion 22, as generally shown in FIG. 2. While the components are maintained in this position or orientation, the valve assembly 28 is then crimped to the pedestal portion 22 of the mounting cup 10, in a conventional manner, to permanently retain the valve assembly 28 within the pedestal portion 22 of the mounting cup 10, as generally shown in FIG. 3.

Figure 8:
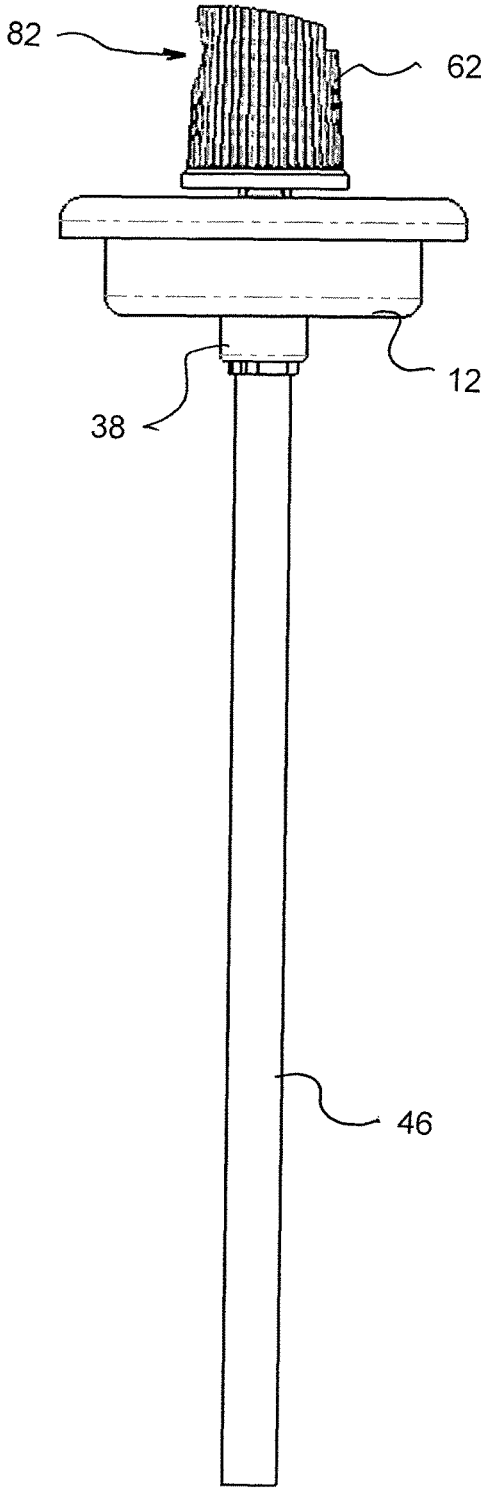
FIG. 8 is a diagrammatic view of the mounting cup and valve assembly combination shown assembled with a dip tube and an actuator.

Following completion of the crimping process, the compressible member 74 is generally only slightly or minimally compressed and an expansion force, of the compressible member 74, along the vertical axis A is sufficient to bias the circumferential sealing surface 64 against the gasket 32 and form the desired fluid tight seal therewith which prevents the flow of the product to be dispensed 48 out through the valve, while the compressible member 74 is still sufficiently compressible so as to permit the discharge of the product to be dispensed 48 from the valve assembly 28. Lastly, a conventional actuator 62 is frictionally installed on the free end of the cylindrical tubular section 36 of the valve stem 24 while a conventional dip tube 46 frictionally engages with the dip tube coupling 42 in order to complete fabrication of the improved mounting cup and valve assembly combination, as generally shown in FIG. 8.

Although product to be dispensed 48 has continuous access to the interior chamber 50 of the valve body 38, via the dip tube 46 and the dip tube coupling 42, the sealing engagement between the circumferential sealing surface 64 and the gasket 32 prevents the product to be dispensed 48 from communicating with and flowing through the radial orifices 68 or the outlet product passage 66 until the valve stem 24 is sufficiently (vertically) depressed by an operator, or possibly tilted by an operator for a tilt valve application. However, when the valve assembly 28 is sufficiently depressed by an operator into its actuated state, as shown in FIG. 6, due to application of a vertical actuation force F to the valve stem 24 along the vertical axis A, such application force, in turn, causes compression of the compressible member 74, e.g., decreases its vertical height dimension D while generally increases its horizontal circumference W (see FIG. 2A). Such compression of the compressible member 74 also causes the circumferential sealing surface 64 to be moved vertically downward along the axis A, toward the partially closed base 40 of the valve body 38, and out of sealing engagement with the gasket 32. Such sequence of events creates a product flow path from the interior chamber 50 of the valve body 38, past the circumferential sealing surface 64, into the radial orifices 68 and the outlet product passage 66 of the generally cylindrical tubular section 36. The pressurized product to be dispensed 48 thus travels from the interior compartment of the canister 14, up through the dip tube 46, the dip tube coupling 42 and the product bypass slot(s) 80 and into the interior chamber 50 of the valve body 38 (FIG. 4). From the interior chamber 50 of the valve body 38—since the valve assembly 28 is actuated—the product to be dispensed 48 flows between the circumferential sealing surface 64 and the gasket 32, through the radial orifice(s) 68, along the product outlet passage 66 and out through a discharge orifice 82 formed in the actuator 62.

Figure 7:
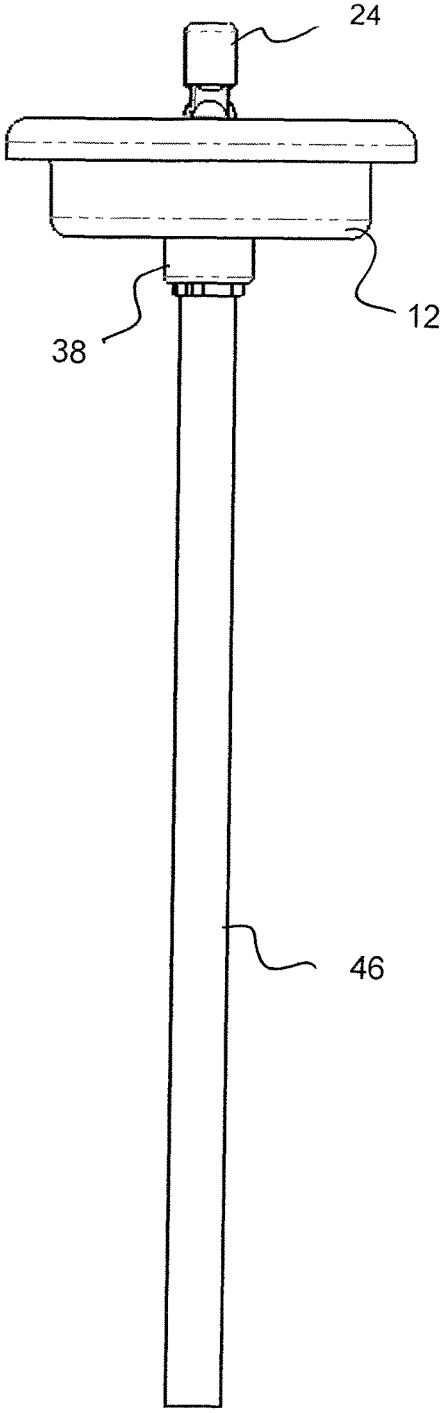
FIG. 7 is a diagrammatic view of the mounting cup and valve assembly combination shown assembled with a dip tube.

FIG. 7 is a diagrammatic view showing the mounting cup and valve assembly combination following assembly with a dip tube and prior to attachment of the actuator 62.

Figure 9:
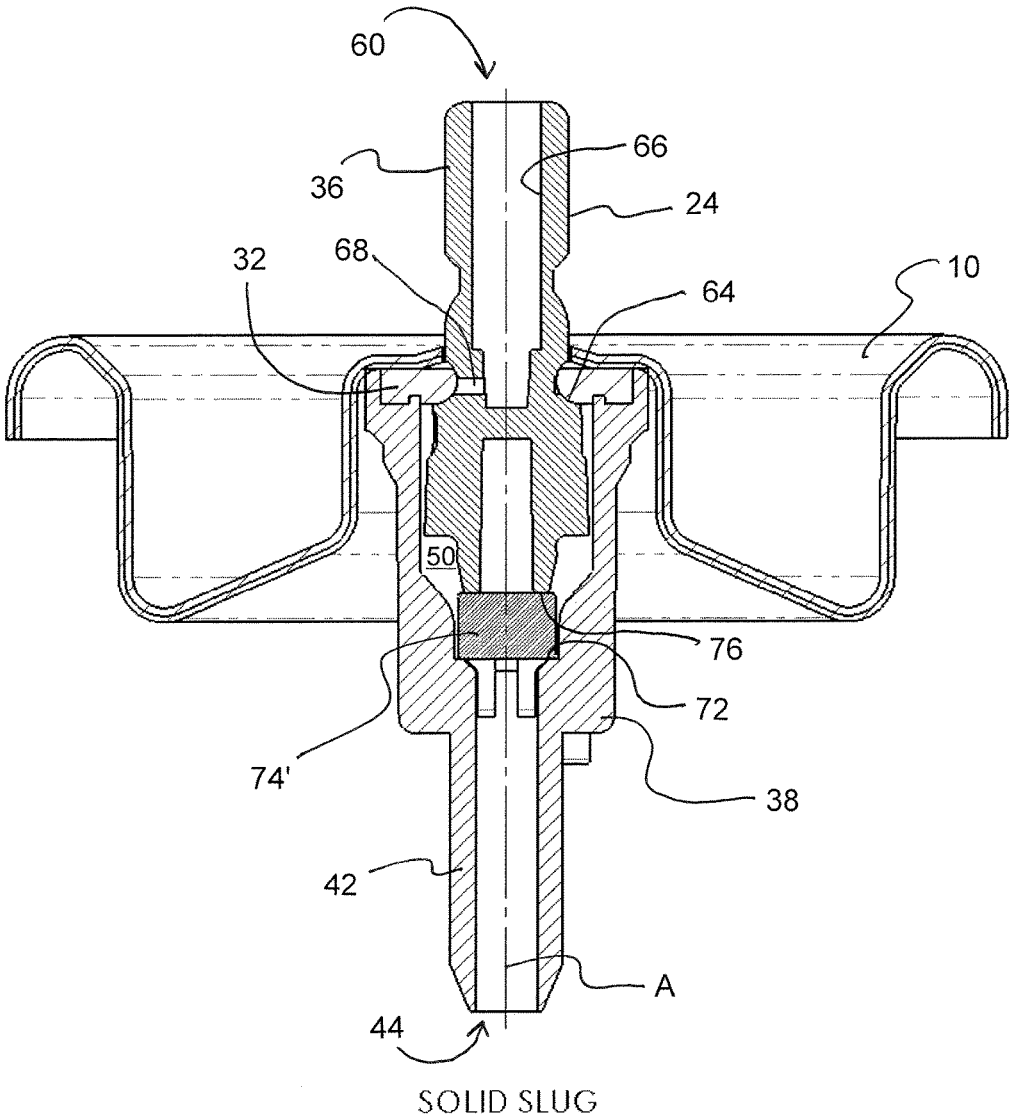
FIG. 9 is a diagrammatic cross-sectional view of the mounting cup and valve assembly combination showing another embodiment of the compressible member and the first and the second seats.

With reference to FIG. 9, a variation of the compressible member is shown. As this embodiment is very similar to the previously discussed embodiment, only the differences between this new embodiment and the previous embodiment will be discussed in detail while identical elements will be given identical reference numerals.

According to this embodiment, the compressible member 74' is a generally solid cylindrical slug, rather than being spherical in shape. Due to the cylindrical shape of the compressible member 74', the shape of the first seat 72 and the second seat 76 are both correspondingly modified so as to accommodate and captively retain the generally circular end surfaces of the solid cylindrical slug.

Figure 10:
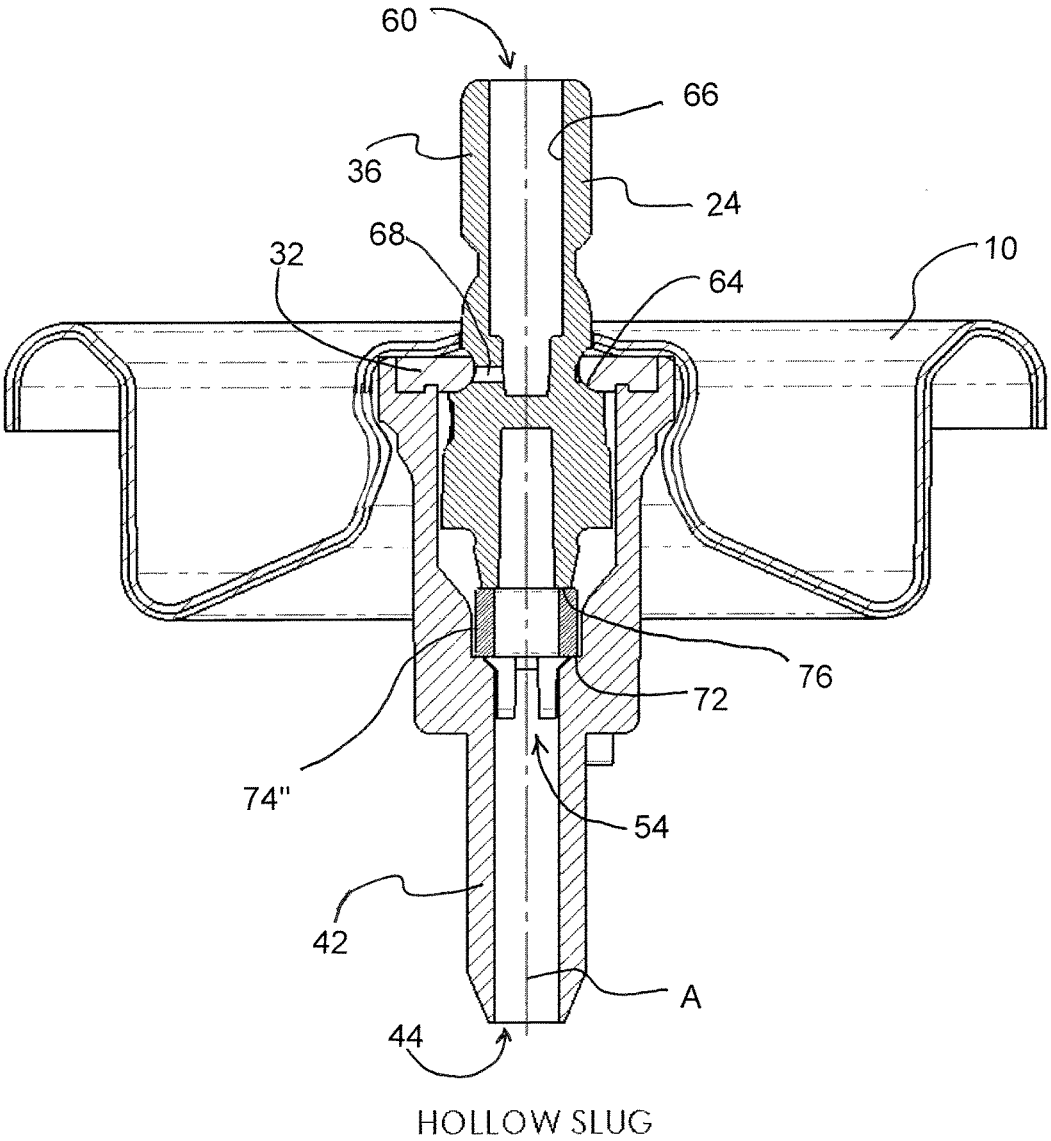
FIG. 10 is a diagrammatic cross-sectional view of the mounting cup and valve assembly combination showing still another embodiment of the compressible member and the first and the second seats.

With reference to FIG. 10, a further variation of the compressible member is shown. As this embodiment is very similar to the previously discussed embodiments, only the differences between this new embodiment and the previous embodiments will be discussed in detail while identical elements will be given identical reference numerals.

According to this embodiment, the compressible member 74" is a generally hollow cylindrical slug, rather than being spherical in shape. Due to the cylindrical shape of the compressible member 74", as with the embodiment of FIG. 9, the shape of the first seat 72 and the second seat 76 are both correspondingly modified so as to accommodate and captively retain the generally annular end surfaces of the hollow cylindrical slug.

Figure 11:
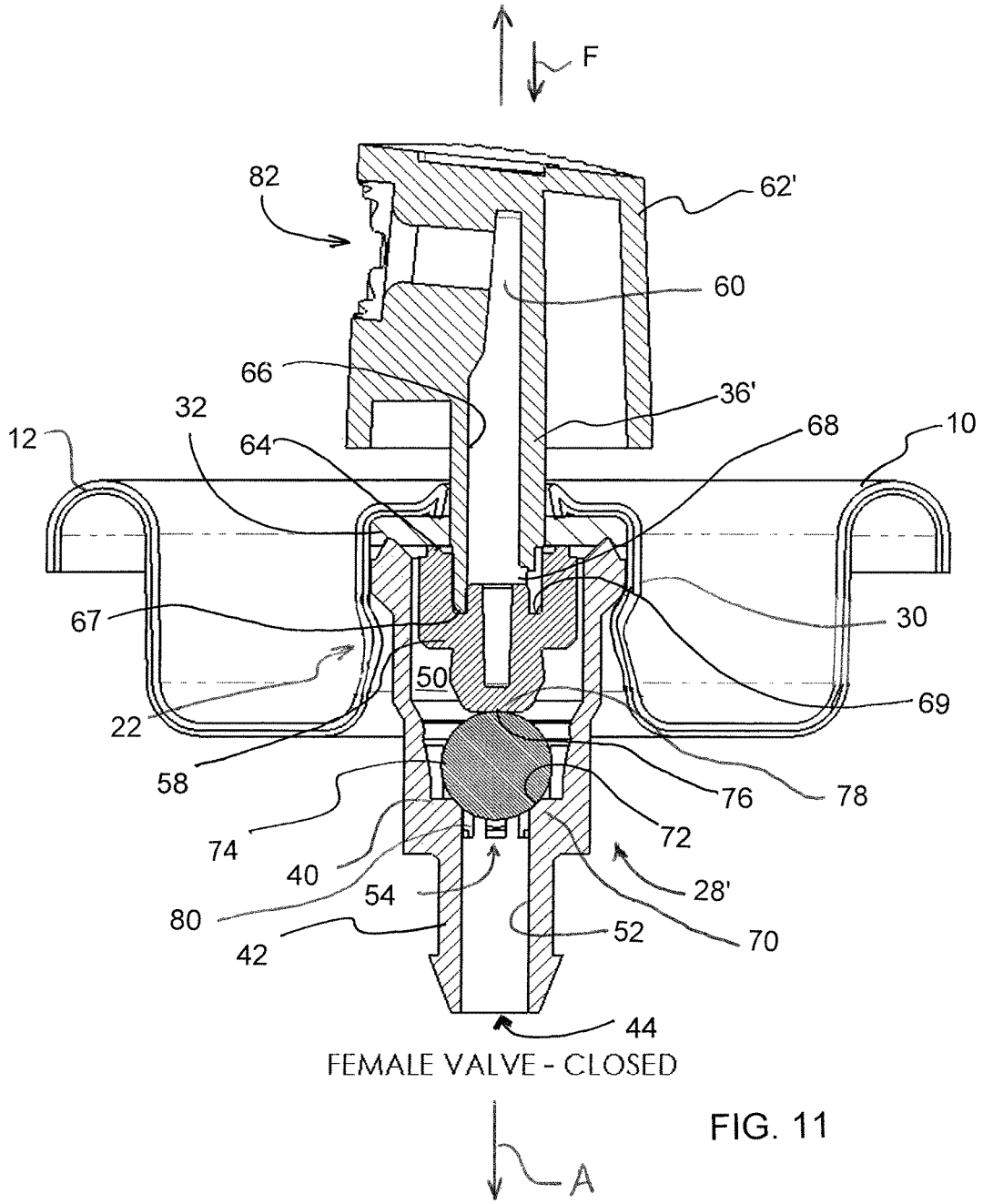
FIG. 11 is a diagrammatic cross-sectional view of the mounting cup and valve assembly combination for a female valve which is shown in its closed unactuated position.
Figure 12:
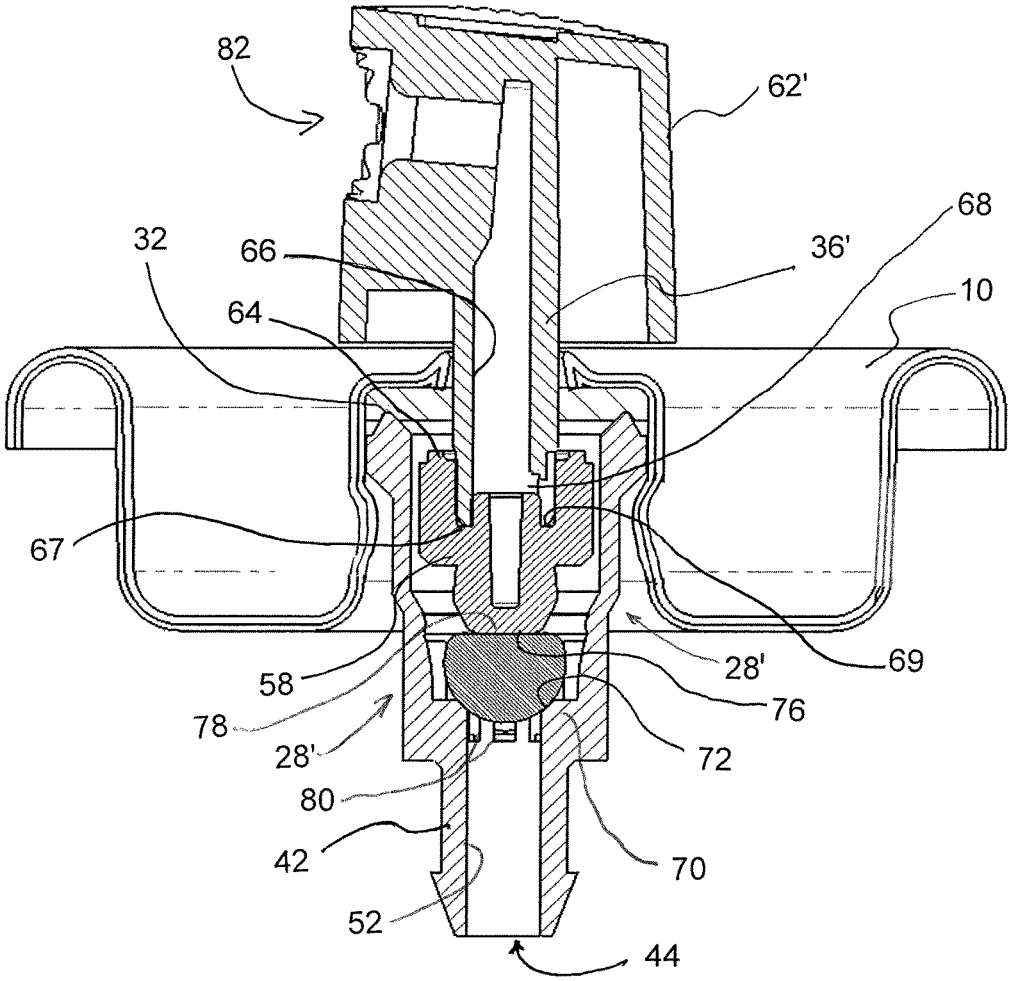
FIG. 12 is a diagrammatic cross-sectional view of the mounting cup and valve assembly combination of FIG. 11, shown in its opened actuated position.

With reference to FIGS. 11 and 12, a further modification of the improved mounting cup and valve assembly combination is shown. As this embodiment is very similar to the previously discussed embodiments, only the differences between this new embodiment and the previous embodiments will be discussed in detail while identical elements will be given identical reference numerals.

According to this modification, the valve assembly is a "female" valve, rather than a "male" valve as generally discussed above. As this embodiment is very similar to the previously discussed male version of the valve assembly, only the significant differences between this embodiment and the previous embodiment will be highlighted.

As with the previous embodiments, the mounting cup 10 is provided with a perimeter curl 12 for attaching the mounting cup 10 to a rim of a desired pressurizable container or canister 14 (see FIG. 1), or to a rim of a dome (not shown). The mounting cup 10 has a central aperture provided therein for accommodating a valve stem of the actuator 62'. The pedestal portion 22 has a generally flat top wall for accommodating the female valve assembly 28'.

A generally flat gasket 32 is disposed along the inwardly facing surface of the top wall 26 of the pedestal portion 22. The gasket 32 has a central aperture formed therein which is typically slightly smaller in size than the aperture provided in the pedestal portion 22 of the mounting cup 10, so as to provide a snug seal with respect to a cylindrical tubular section 36' of the actuator 62'. As generally shown in FIGS. 11 and 12, the aperture of the gasket 32 is aligned with the aperture provided in the pedestal portion 22 and the cylindrical tubular section 36' passes through both the aperture in the pedestal portion 22 and the aperture of the gasket 32. The valve assembly 28' and the cylindrical tubular section 36' of the actuator 62' together define a longitudinal axis A for the improved mounting cup and valve assembly combination. Following crimping of the mounting cup 10, the generally vertical cylindrical side wall 30 is forced radially inward into engagement with an exterior surface of a valve body 38 in order to permanently attach the valve assembly 28' to the mounting cup 10.

The valve body 38 is generally a hollow longitudinal cylindrical member which is open at a top end thereof and partially closed adjacent a base 40 thereof. The open end of the valve body 38 receives and accommodates the valve stem base 58 while the partially closed base 40 of the valve body 38 is provided with a cylindrical dip tube coupling 42 which has an inlet 44, formed in a bottom most free end of the dip tube coupling 42. A first end of a dip tube (not shown in either of these Figures) is connected, in a conventional manner, to the dip tube coupling 42 while a second remote end of the dip tube is located, following installation in the canister 14, adjacent the bottom area of the pressurized canister 14 for communicating with the product to be dispensed 48 and facilitating conveyance of the product to be dispensed 48 from a lower portion of the pressurized canister 14 into an interior chamber 50 of the valve body 38.

The inlet 44 communicates, via a constant diameter supply passage 52, with a passage outlet 54, formed in the base 40 of the valve body 38, which facilitates discharge of the product to be dispensed 48 into the interior chamber 50 of the valve body 38. The dip tube, the product inlet 44, the supply passage 52, and the passage outlet 54 cooperate with one another to facilitate the flow of the product to be dispensed 48 from the pressurized canister 14 into the central interior chamber 50 of the valve body 38 for dispensing via the actuator 62', in a conventional manner.

The open end of the valve body 38 includes a perimeter, circumferential rim which is sized, shaped and dimensioned to engage with and form a seal with an outer perimeter region of the gasket 32, following crimping. The open end of the valve body 38 accommodates the valve stem base 58. The valve stem base 58 has a circumferential sealing surface, facing toward the gasket 32, which forms a fluid tight seal with the gasket 32.

The generally cylindrical tubular section 36', which is formed as part of the actuator 62', has a product outlet 60. A longitudinal through-bore or outlet product passage 66 extends through the generally cylindrical tubular section 36' from adjacent the valve stem base 58 to the product outlet 60.

At least one and possibly a plurality of radial extending orifices 68 extend through the cylindrical tubular section 36' at a location proximate to but spaced axially from the valve stem base 58 so as to provide a product flow path into the longitudinal through-bore or the outlet product passage 66, when the actuator 62' is sufficiently depressed, as shown in FIG. 12. It is to be appreciated that the shape, size and/or orientation of the radial orifices 68 can vary depending upon the particular application, without departing from the spirit and scope of the invention. A leading annular edge 67 of the generally cylindrical tubular section 36' of the actuator 62' typically frictionally engages with a mating annular recess 69, provided in an upwardly facing surface of the valve stem base 58, to frictionally couple the actuator 62' to the valve stem base 58 and facilitate operation and dispensing of the product to be dispensed 48.

As with the previous embodiments, a plurality of spacer walls or members 70 project axially upward from the partially closed base 40 of the valve body 38 and the upper surface of each of the spacer members 70, facing toward the open end of the valve body 38, combine with one another to form an annular first seat 72 for accommodating a first portion of a compressible member 74. In addition, a vertically lower most base surface 78 of the valve stem base 58, facing toward the partially closed base 40 of the valve body 38, forms a mating annular second seat 76. That is, the mating annular second seat 76 is a contoured (either generally flat or slightly curved in this embodiment) surface which is sized and shaped to matingly engage with an exterior surface of the compressible member 74. Following installation, the compressible member 74 is captively accommodated and retained within the interior chamber 50 of the valve body 38, between the first seat 72 and the mating second seat 76 (see FIGS. 11 and 12).

As with the previous embodiments, the valve body 38 typically has at least one radially and axially extending product bypass slot 80 which continuously permits the product to be dispensed 48 to flow out from the passage outlet 54 of the valve body 38, around and past the compressible member 74 and into the interior chamber 50 of the valve body 38 while the compressible member 74 remains constantly and continuously seated on the first seat 72 of the valve body 38. That is, each product bypass slot 80 forms a product bypass passageway in which the flow therethrough is not obstructed by the compressible member 74, even though the compressible member 74 remains permanently and constantly seated on the first seat 72 which is located above and axially spaced from the passage outlet 54.

The compressible member 74 normally biases the circumferential sealing surface 64 of the valve stem base 58 axially away from the partially closed base 40 of the valve body 38 and into sealing engagement with an undersurface of the gasket 32. However, when the actuator 62' is depressed by an operator so that the valve stem base 58 moves toward the partially closed base 40 of the valve body 38, the compressible member 74 is, in turn, sufficiently compressed so that the circumferential sealing surface 64 of the valve stem base 58 moves out of sealing engagement with the gasket 32 and thereby permits the product to be dispensed 48 to flow from of the interior chamber 50 into the radial orifice(s) 68 and the outlet product passage 66 and eventually toward the discharge orifice 82 of the actuator 62', as shown in FIG. 12.

Although product to be dispensed 48 has continuous access to the interior chamber 50 of the valve body 38, via the dip tube 46 and the dip tube coupling 42, the sealing engagement between the circumferential sealing surface 64 and the gasket 32 prevents the product to be dispensed 48 from communicating with the radial orifices 68 or the outlet product passage 66 until the actuator 62' is sufficiently (vertically) depressed by an operator, or possibly tilted by an operator for a tilt valve application. However, when the valve assembly 28' is sufficient actuated by an operator into its actuated state, as shown in FIG. 12, due to application of a vertical actuation force F to the actuator 62' along the vertical axis A, such application force, in turn, causes compression of the compressible member 74 and this, in turn, causes the circumferential sealing surface 64 to be moved vertically downward along the axis A, toward the partially closed base 40 of the valve body 38, and out of sealing engagement with the gasket 32. Such sequence of events creates a product flow path from the interior chamber 50 of the valve body 38, past the circumferential sealing surface 64, into the radial orifices 68 and the outlet product passage 66 of the generally cylindrical tubular section 36' of the actuator 62'. The pressurized product to be dispensed 48 thus flows from the interior compartment of the canister 14, up through the dip tube 46, the dip tube coupling 42 and the product bypass slot(s) 80 and into the interior chamber 50 of the valve body 38. From the interior chamber 50 of the valve body 38—since the valve assembly 28' is actuated—the product to be dispensed 48 flows between the circumferential sealing surface 64 and the gasket 32, through the radial orifice(s) 68, along the product outlet passage 66 and out through the discharge orifice 82 formed in the actuator 62'.

As with the previous embodiments, the important aspect is that the compressible member 74 normally bias the circumferential sealing surface 64 of the valve stem 24 into sealing engagement with the gasket 32 while still being sufficiently compressible so as to permit the circumferential sealing surface 64 of the valve stem 24 to be moved out of sealing engagement with the gasket 32 and thereby permit product flow.

Figure 13:
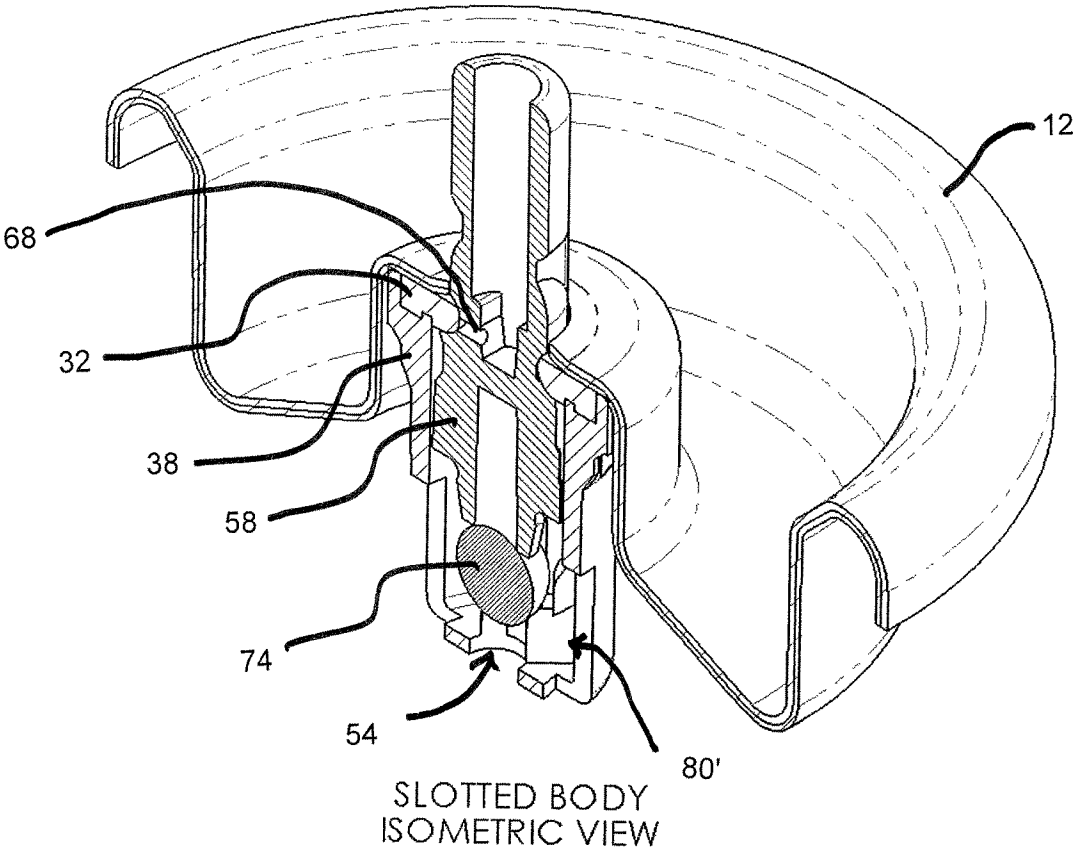
FIG. 13 is a diagrammatic cross-sectional perspective view of the mounting cup and valve assembly combination showing a slotted body embodiment.
Figure 14:
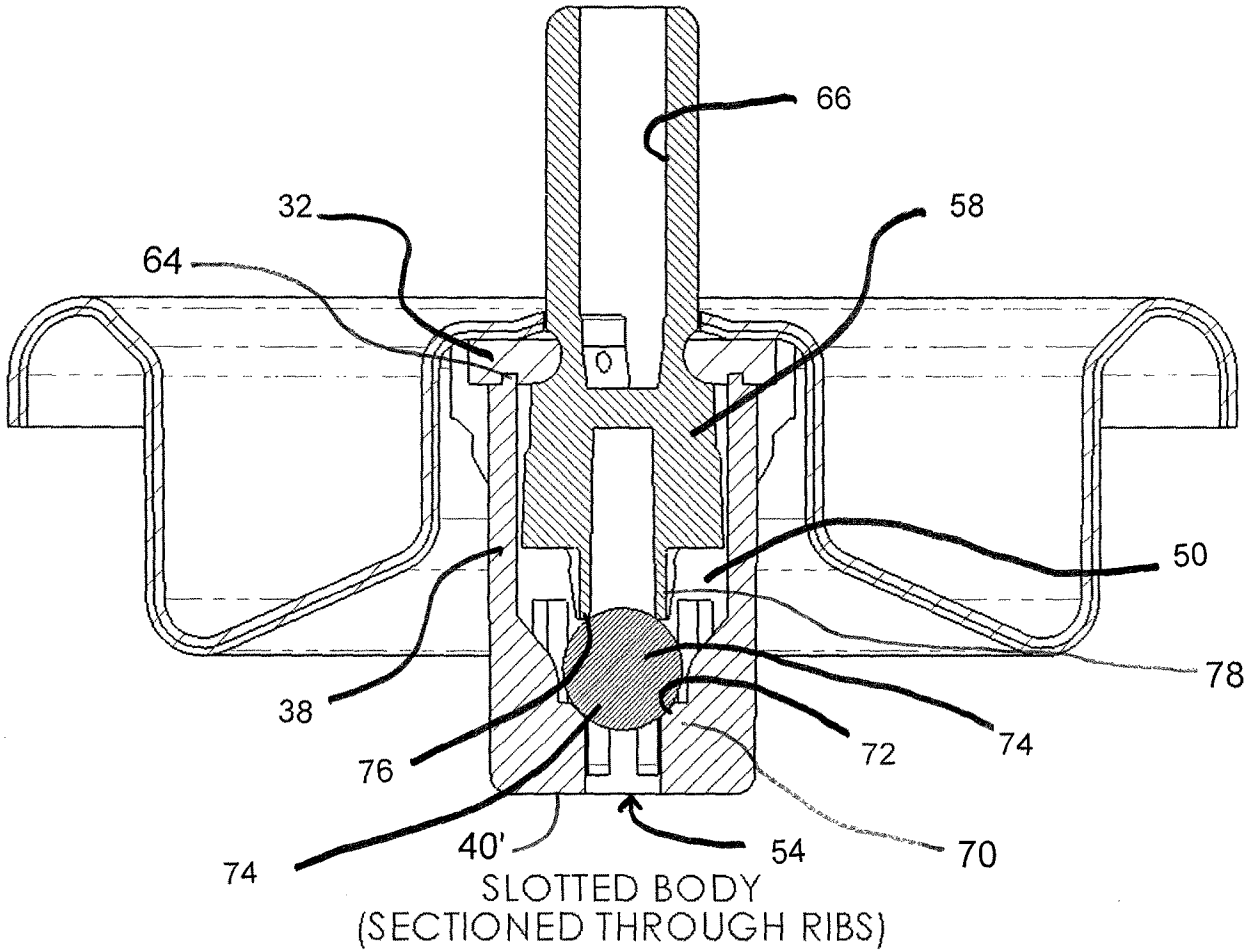
FIG. 14 is a diagrammatic cross-sectional view of the mounting cup and valve assembly combination of FIG. 13 along a pair of spacer members of the slotted body.
Figure 15:
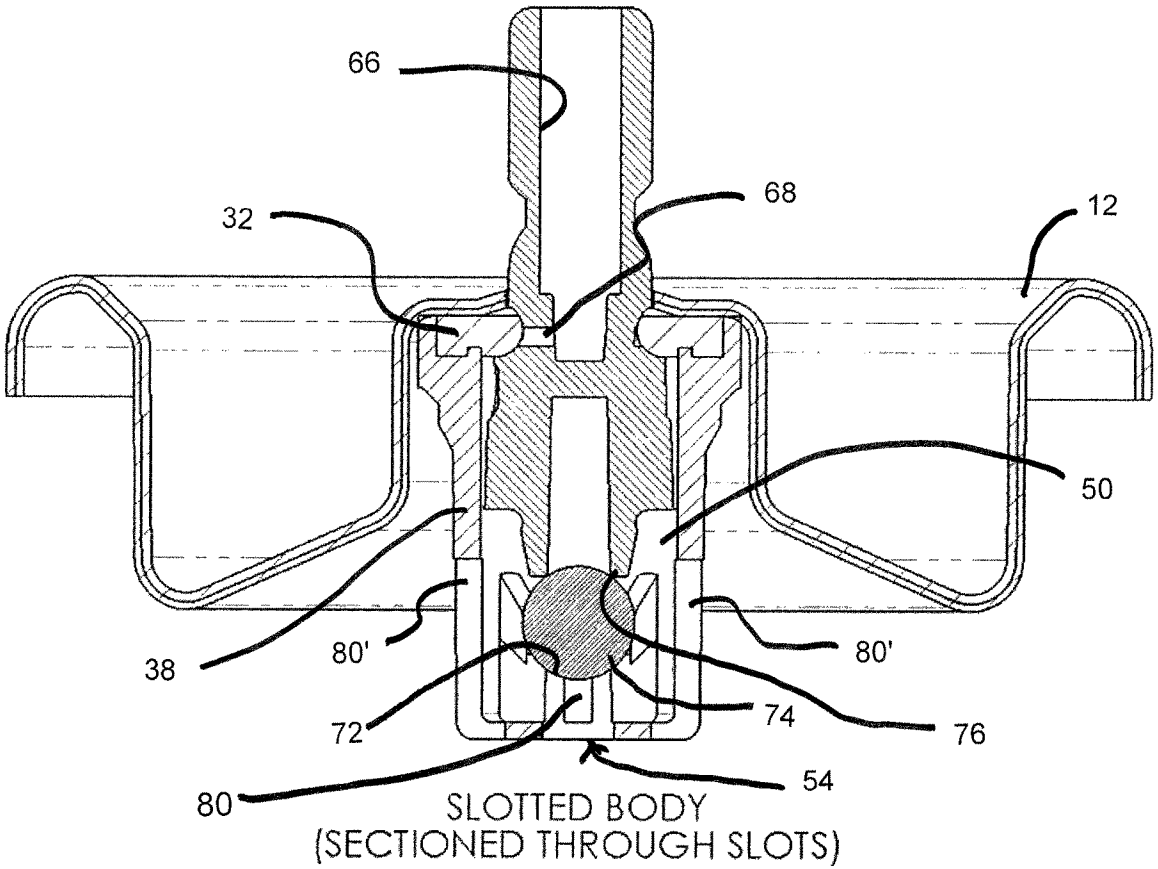
FIG. 15 is a diagrammatic cross-sectional view of the mounting cup and valve assembly combination of FIG. 13 along a pair of inlet apertures of the slotted body.

With reference to FIGS. 13-15, yet another modification of the improved mounting cup and valve assembly combination is shown. As this embodiment is very similar to a number of the previously discussed embodiments, only the differences between this new embodiment and the previous embodiments will be discussed in detail while identical elements will be given identical reference numerals.

According to this embodiment, the dip tube coupling and the dip tube are eliminated and the base 40' of the valve body 38 is modified so that the product to be dispensed 48 has continuous access to the interior chamber 50 of the valve body 38 via either the passage outlet 54 or one or more inlet apertures 80', formed in a lower section of the sidewall of the valve body 38. As with the previous embodiments, the sealing engagement between the circumferential sealing surface 64 and the gasket 32 prevents the product to be dispensed 48 from communicating with the radial orifices 68 (see FIG. 15) or the outlet product passage 66 until the actuator (not shown) is sufficiently (vertically) depressed by an operator, or possibly tilted by an operator for a tilt valve application.

Similar to the previous embodiments, a plurality of spacer walls or members 70, e.g., generally between 2 and 6 product spacer members, project axially upward from the base 40' of the valve body 38 and the upper surface of each of the spacer members 70, facing toward the open end of the valve body 38, combine with one another to form an annular first seat 72 for accommodating a first portion of the compressible member 74. In addition, a vertically lower most base surface 78 of the valve stem base 58, facing toward the base 40' of the valve body 38, forms a mating annular second seat 76. Following installation, the compressible member 74 is accommodated within the interior chamber 50 of the valve body 38, between the first seat 72 and the mating second seat 76. As with the previous embodiments, as a result of such arrangement, following assembly, the compressible member 74 is generally captively retained within the interior chamber 50 of the valve body 38 between the first seat 72 and the mating second seat 76.

As with the previous embodiments, the valve body 38 typically has at least one radially and axially extending product bypass slot 80, e.g., four product bypass slots are generally shown is these figures. A respective product bypass slot 80 is formed between each adjacent pair of the plurality of spacer members 70, e.g., generally between 2 and 6 product bypass slots or so are formed in the valve body 38. Each one of the product bypass slots 80 also continuously permits the product to be dispensed 48 to flow through the passage outlet 54 of the valve body 38, around and past the compressible member 74 and into the interior chamber 50 of the valve body 38 while the compressible member 74 remains constantly and continuously seated on the first seat 72 of the valve body 38. According to this embodiment, both the product bypass slots 80 and the inlet apertures 80' form product bypass passageways in which the flow of the product to be dispensed 48 is not obstructed by the compressible member 74, even though the compressible member 74 remains permanently and constantly seated on the first seat 72 located above and axially spaced from the passage outlet 54.

In the accompanying drawings, the improved mounting cup and valve assembly combination, according to the present invention, is generally illustrated for use with a vertical valve. However, it is to be appreciated by those of ordinary skill in the art that such improved mounting cup and valve assembly combination could readily be used with a tilt-valve assembly as well as female valves without departing from the spirit and scope of the invention. Since certain changes may be made in the above described mounting cup and valve assembly combination, without departing from the spirit and scope of the invention herein involved, it is intended that all of the subject matter of the above description or shown in the accompanying drawings shall be interpreted merely as examples illustrating the inventive concept herein and shall not be construed as limiting the invention.

It is to be understood that the phraseology and terminology used herein is for the purpose of description and should not be regarded as limiting. The use of "including," "comprising," or "having," and variations thereof herein, is meant to encompass the items listed thereafter and equivalents thereof as well as additional items while only the terms "consisting of" and "consisting only of" are to be construed in a limitative sense. The foregoing description of the embodiments of the present disclosure has been presented for the purposes of illustration and description. It is not intended to be exhaustive or to limit the present disclosure to the precise form disclosed. Many modifications and variations are possible in light of this disclosure. It is intended that the scope of the present disclosure be limited not by this detailed description, but rather by the claims appended hereto.

Wherefore, we claim:

1. A mounting cup and valve assembly combination for an aerosol container, the combination comprising:

a mounting cup having a pedestal portion and a perimeter curl;

a valve stem having a product outlet and at least one radial orifice being formed therein and communicating with the product outlet;

a valve body being opened at a first end and defining an interior chamber, the valve body having a dip tube coupling adjacent a partially closed base thereof, and the dip tube coupling facilitates conveying product to be dispensed into the interior chamber of the valve body, the valve stem being axially movable between an open position in which the product to be dispensed is dispensed through the valve assembly, and a closed position in which dispensing of the product to be dispensed through the valve assembly is prevented; and a gasket being sandwiched between the valve body and the mounting cup;

wherein the base of the valve body forms a first seat while a surface of the valve stem, facing toward the partially closed base, forms a second seat; and a rubber compressible member is captively retained between the first and the second seats, the compressible member directly contacts the first and the second seats in both the open and the closed positions; and the valve body, adjacent the first seat, has at least one product bypass slot which extends radially and axially, and the compressible member diverting the product to be dispensed radially outward through the at least one product bypass slot, and the product to be dispensed flowing axially along the valve assembly between an inwardly facing surface of the valve body and an outer surface of the rubber compressible member and an outer surface of a base of the valve stem toward the at least one radial orifice.

2. The mounting cup and valve assembly combination according to claim 1, wherein the compressible member continually applying a closing force on the valve stem to bias the valve stem into the closed position in which the valve stem sealingly engages the gasket, while still being sufficiently compressible so as to permit the valve stem to be moved out of sealing engagement with the gasket into the open position which permits the product to be dispensed to flow through the valve assembly.

3. The mounting cup and valve assembly combination according to claim 1, wherein the compressible member is manufactured from nitrile rubber which is a synthetic rubber copolymer of acrylonitrile(ACN) and butadiene.

4. The mounting cup and valve assembly combination according to claim 1, wherein the compressible member is resistant to oil and fuel so as to minimize the compressible member from reacting or otherwise altering any physical or chemical characteristic, property or attribute of the product to be dispensed.

5. The mounting cup and valve assembly combination according to claim 1, wherein the compressible member is one of spherical and cylindrical in shape.

6. The mounting cup and valve assembly combination according to claim 1, wherein the compressible member has a height dimension, measured along a vertical axis of the valve assembly, of between 0.050 and 0.500 of an inch.

7. The mounting cup and valve assembly combination according to claim 1, wherein the dip tube coupling is formed in the partially closed base of the valve body and the dip tube coupling has a product inlet, a supply passage, and a passage outlet which cooperate with one another to facilitate the flow of the product to be dispensed into the interior chamber of the valve body for dispensing.

8. The mounting cup and valve assembly combination according to claim 7, wherein a first end of a dip tube is connected to the dip tube coupling while a second remote end of dip tube is positionable for communication with the product to be dispensed.

9. The mounting cup and valve assembly combination according to claim 7, wherein the open end of the valve body engages with and forms a fluid tight seal with the gasket.

10. The mounting cup and valve assembly combination according to claim 7, wherein an actuator, with a discharge outlet, frictionally engages with a free end of the valve stem to facilitate dispensing of the product to be dispensed.

11. The mounting cup and valve assembly combination according to claim 10, wherein the valve stem has a circumferential sealing surface, facing toward the gasket, which is normally biased into sealing engagement with the gasket by the compressible member.

12. The mounting cup and valve assembly combination according to claim 1, wherein the first seat is formed by a plurality of spacer members which project from the partially closed base of the valve body, and a product bypass slot is formed between each adjacent pair of the plurality of spacer members, the spacer members are circumferentially disposed about the interior chamber such that diametrically oppsite spacer members are spaced apart from each other.

13. The mounting cup and valve assembly combination according to claim 1, wherein the compressible member is axially aligned with the dip tube coupling such that, when the valve stem is in the open position the product to be dispensed axially flows through the dip tube coupling, radially between the inwardly facing surface of the valve body and the outer surface of the rubber compressible member and the outer surface of a base of the valve stem, and through the at least one radial orifice and the product outlet of the valve stem.

14. The mounting cup and valve assembly combination according to claim 12, wherein the plurality of spacer members combine with one another to form the first seat for accommodating the compressible member, and the base surface of the valve stem, facing toward the partially closed base of the valve body, forms the second seat which is sized and annularly shaped to continually matingly engage with an exterior contour of the compressible member.

15. The mounting cup and valve assembly combination according to claim 1, wherein the compressible member is captively retained within the interior chamber of the valve body between the first seat and the second seat.

16. The mounting cup and valve assembly combination according to claim 12, wherein the plurality of spacer members sufficiently space the compressible member away from a passage outlet of the valve body so that the product to be dispensed can constantly and continuously flow into the interior chamber of the valve body without being obstructed by the compressible member.

17. A mounting cup and valve assembly combination for an aerosol container, the combination comprising:

a mounting cup having a pedestal portion and a perimeter curl, and an aperture being formed in the pedestal portion of the mounting cup;

a valve stem having a cylindrical tubular section extending from a base of the valve stem, a product outlet being formed in a free end of the cylindrical tubular section, and at least one radial orifice being formed in the cylindrical tubular section and communicating with the product outlet, the valve stem being axially movable between an open position in which product to be dispensed is dispensed through the valve assembly, and a closed position in which dispensing of the product to be dispensed through the valve assembly is prevented;

a valve body being opened at a first end and defining an interior chamber, the valve body having a dip tube coupling adjacent a partially closed base thereof, and the dip tube coupling being connected to a dip tube to facilitate conveying the product to be dispensed into the interior chamber via a passage outlet;

the base of the valve stem being received within the interior chamber of the valve body;

a gasket being sandwiched between the open end of the valve body and the mounting cup with a portion of the cylindrical tubular section extending through the aperture in the mounting cup; and an actuator, with a discharge outlet, frictionally engaging with the free end of the cylindrical tubular section to facilitate dispensing of the product to be dispensed;

wherein the partially closed base of the valve body forms a first seat while a surface of the valve stem, facing toward the partially closed base of the valve body, forms a mating second seat;

a rubber compressible member is captively retained between the first and the second seats without obstructing the passage outlet in the partially closed base of the valve body, the compressible member directly contacting the first and the second seat in both the closed position and the open position of the valve stem; and the compressible member continually, directly contacts the first and the second seats to resist movement of the valve stem from the closed position, the compressible member automatically biases the valve stem into sealing engagement with the gasket while still being sufficiently compressible so as to permit the valve stem to be moved out of sealing engagement with the gasket and permit product flow through the valve assembly.

18. The mounting cup and valve assembly combination according to claim 17, wherein the first seat is formed by a plurality of spacer members which project from the partially closed base of the valve body, and at least one product bypass slot is formed between an adjacent pair of the plurality of spacer members, the compressible member diverting the product to be dispensed through the at least one product bypass slot into the interior chamber of the valve body.

19. The mounting cup and valve assembly combination according to claim 17, wherein the compressible member is manufactured from nitrile rubber which is a synthetic rubber copolymer of acrylonitrile(ACN) and butadiene;

the compressible member is one of spherical and cylindrical in shape; and the compressible member has a height dimension, measured along a vertical axis of the valve assembly, of between 0.050 and 0.500 of an inch.

20. A mounting cup and valve assembly combination for an aerosol container, the combination comprising:

a mounting cup having a pedestal portion and a perimeter curl;

a valve body being opened at a first end and defining an interior chamber, the valve body having a product outlet formed in a base thereof which facilitates conveying product to be dispensed into the interior chamber of the valve body;

a valve stem being received within the interior chamber of the valve body, the valve stem being axially movable between an open position in which the product to be dispensed is dispensed through the valve assembly, and a closed position in which dispensing of the product to be dispensed through the valve assembly is prevented;

a gasket being sandwiched between the valve body and the mounting cup and normally preventing flow of product to be dispensed through valve assembly;

wherein the base of the valve body forms a first seat while a surface of the valve stem, facing toward the partially closed base, forms a second seat;

a rubber compressible member is captively retained between the first and the second seats, the compressible member being the sole component biasing the valve stem back into sealing engagement with the gasket to prevent the flow of the product to be dispensed through valve assembly, and the compressible member directly contacting the first and the second seats in both the open and the closed positions; and the valve body, adjacent the first seat, has at least one product bypass slot which extends radially and axially, the valve body diverting the flow of the product to be dispensed radially outward through the at least one product bypass slot, and the product to be dispensed flowing axially along the valve assembly between an inwardly facing surface of the valve body and an outer surface of the rubber compressible member and an outer surface of a base of the valve stem toward the at least one radial orifice.

* * * * *